US005232400A

United States Patent [19]

Chang et al.

[11] Patent Number: 5,232,400

[45] Date of Patent: Aug. 3, 1993

[54] CONNECTOR DEVICE

[75] Inventors: Mon Shing Chang; Chou Lin Chen, both of Taoyuan; Li-Chang Hsu, Chung-Li, all of Taiwan

[73] Assignee: E. I. Du Pont de Nemours and Company, Wilmington, Del.

[21] Appl. No.: 768,136

[22] Filed: Sep. 26, 1991

[51] Int. Cl.[5] ..... H01R 13/62

[52] U.S. Cl. ..... 439/326

[58] Field of Search ..... 439/59-62, 439/630-636, 325, 326-329, 357, 358

[56] References Cited

U.S. PATENT DOCUMENTS

| | | | |
|---|---|---|---|
| 4,995,825 | 2/1991 | Korsunsky et al. | 439/326 X |
| 5,004,429 | 4/1991 | Yagi et al. | 439/326 |
| 5,013,257 | 5/1991 | Korsunsky et al. | 439/326 |
| 5,041,005 | 8/1991 | McHugh | 439/326 |
| 5,100,337 | 3/1992 | Lee Chao | 439/326 |

*Primary Examiner*—Larry I. Schwartz
*Assistant Examiner*—Khiem Nguyen

[57] ABSTRACT

A connector device comprising: a housing made of an insulating material, which has a groove including connection terminals for coming into electrical contact with a row array of connection terminals of a first circuit board inserted therein and with a second circuit board, the first circuit board being partially housed in the groove; latching means having a pair of metal strips mutually oppositely provided one at each end of the housing at an interval corresponding to a length of the first circuit board in a direction in which the connection terminals are arranged as the row array; the pair of metal strips elastically holding the partially inserted first circuit board therebetween under an elastic force acting in a direction perpendicular to that in which the connection terminals of the first circuit board are arranged as the row array; holding means for holding the latching means relative to the housing; and fixing means for positionally fixing the first circuit board, which is held by the latching means, relative to the housing in a direction of the thickness of the first circuit board.

4 Claims, 6 Drawing Sheets

CONNECTOR DEVICE

BACKGROUND OF THE INVENTION

1. Field of the Invention

The present invention relates to a connector device for connecting, for example, printed circuit boards to each other.

2. Description of the Related Art

A connector device 50 as shown, for example, in FIG. 1 is known as a connector device for making an electrical connection between, for example, printed circuit boards. The connector device 50 is used to electrically connect a first circuit board 53 to a second circuit board 63 and has a housing 51 made of plastics. The first circuit board 53 is diagonally inserted into a groove 52 of the housing 51 and swung, in a direction as indicated by an arrow 54, to an upright position as shown in FIG. 2. The upright circuit board 53 makes electrical contact with connection terminals 55 by being sandwiched by spring force of the connection terminals 55 held in a groove. A pair of latching sections 56, 57 are provided on both the end portions of the housing 51 to securely hold the circuit board in the upright position. During the swinging of the circuit board 53, the latching sections 56 and 57 are pushed, while being elastically flexed outwardly of the housing, away from each other by the circuit board 53 and, upon the reaching the upright position, returned back to an original position, thus holding end surfaces 58 and 59 of the circuit board 53 therebetween. At the same time, those mutually facing faces 60 and 61 of projections of the latching sections S6 and S7 support a surface 62 of the circuit board, holding the circuit board 53 to the upright position. Upon the detachment of the circuit board 53 from the connector device 50, the latching sections 56 and 57 are pushed and outwardly flexed, away from each other, removing the circuit board. 53 from the connector device. The latching sections 56 and 57 are made of plastics and formed integral with the housing 51.

However, the plastics latching sections 56 and 57 used in the conventional connector device are liable to crack, break, etc., failing to impart any adequate withstand property to the connector device. Further, upon the repeated attachment and detachment of the circuit board to and from the connector device, the latching sections are not returned back to the original position and the board holding force of the latching sections is decreased, enabling no adequate electrical connection to be made between the circuit board and the connection terminals. The latching sections are also liable to be damaged or worm out due to a frictional force involved upon the attachment and detachment of the circuit board to and from the connector device. It is difficult to manufacture the latching sections of complex shape such that they are formed integral with the housing with the use of plastics. High accuracy is required upon the manufacture of such complex latching sections. Due to the limited flexibility of the plastics, a considerable force is also required when the latching sections are pushed away from each other upon the attachment and detachment of the circuit board.

SUMMARY OF THE INVENTION

It is accordingly the object of the present invention to provide a connector device having a readily manufactureable latching means of longer durability.

According to the present invention, there is provided a connector device comprising: a housing made of an insulating material, which has a groove including connection terminals for coming into electrical contact with a row array of connection terminals of a first circuit board and inserted therein and with second circuit board, the first circuit board being partially housed in the groove; latching means having a pair of metal strips mutually oppositely provided one at each end of the housing at an interval corresponding to a length of the first circuit board in a direction in which the connection terminals are arranged as the row array, the pair of metal strips elastically holding the partially inserted first circuit board therebetween under an elastic force acting in a direction perpendicular to that in which the connection terminals of the first circuit board are arranged as the row array; holding means for holding the latching means relative to the housing; and fixing means for positionally fixing the first circuit board, which is held by the latching means, relative to the housing in a direction of the thickness of the first circuit board.

The connector device of the present invention utilizes metal strips, as a latching means, in place of conventionally employed latching sections made of plastics. The use of such metal strips ensures remarkably durable latching sections and can maintain their stable and strong holding power even in the event of the repeated attachment and detachment of the metal strips to and from the connector device. In the connector device of the present invention, it is possible to ready replace damaged metal strips with new ones. Further, since the metal strips are provided separate from the housing and replaceable as separate members, the accuracy with which the housing is formed is alleviated, ensuring ready manufacture of the housing.

DETAILED DESCRIPTION OF THE PREFERRED EMBODIMENTS

A connector device according to one embodiment of the present invention will be explained below with reference to the accompanying drawings.

Figure 1:
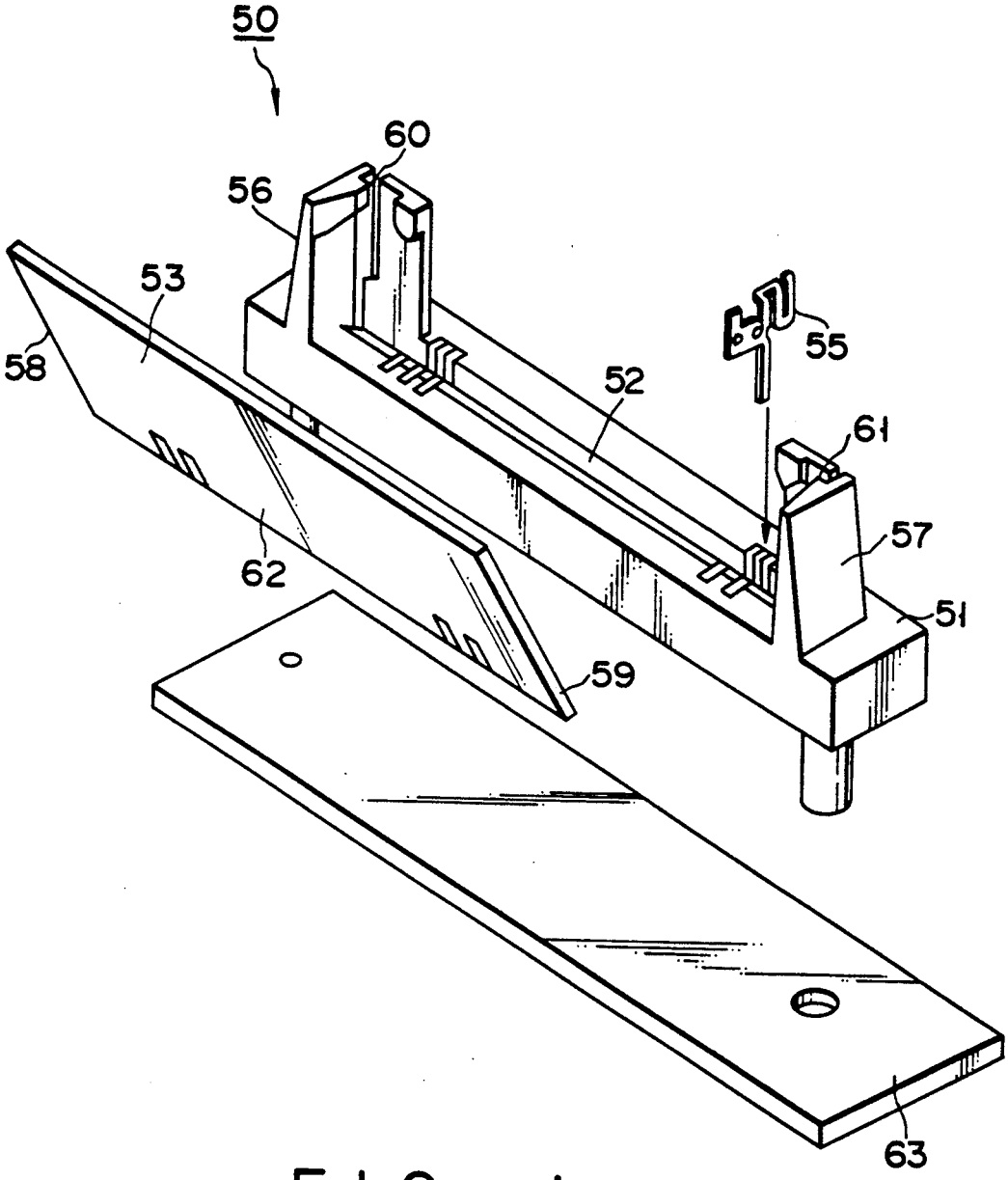
FIG. 1 (PRIOR ART)
FIG. 1 is a perspective view showing a conventional connector device.
Figure 2:
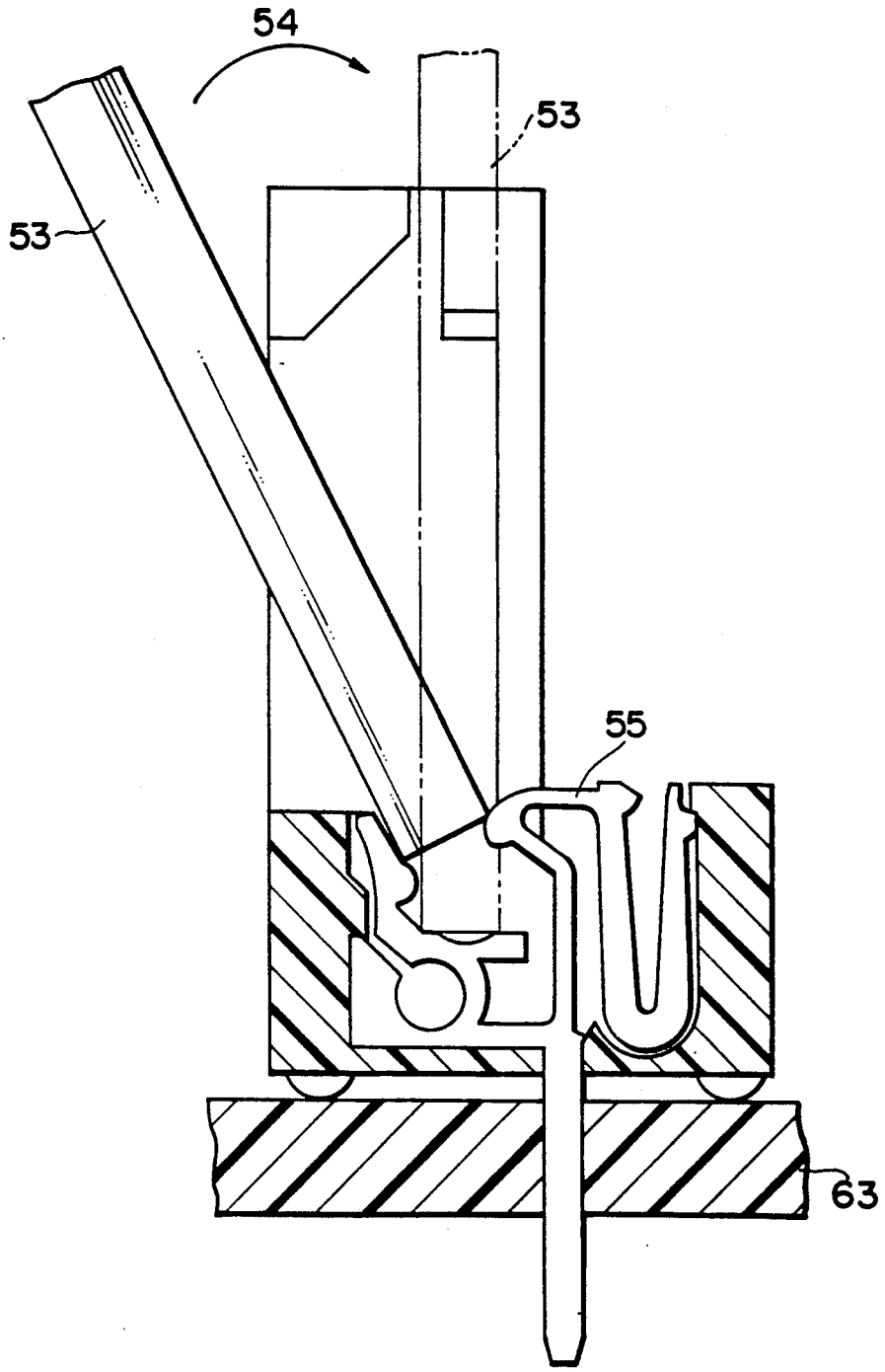
F I G. 2 (PRIOR ART)
FIG. 2 is a cross-sectional view showing the connector device shown in FIG. 1.
Figure 3:
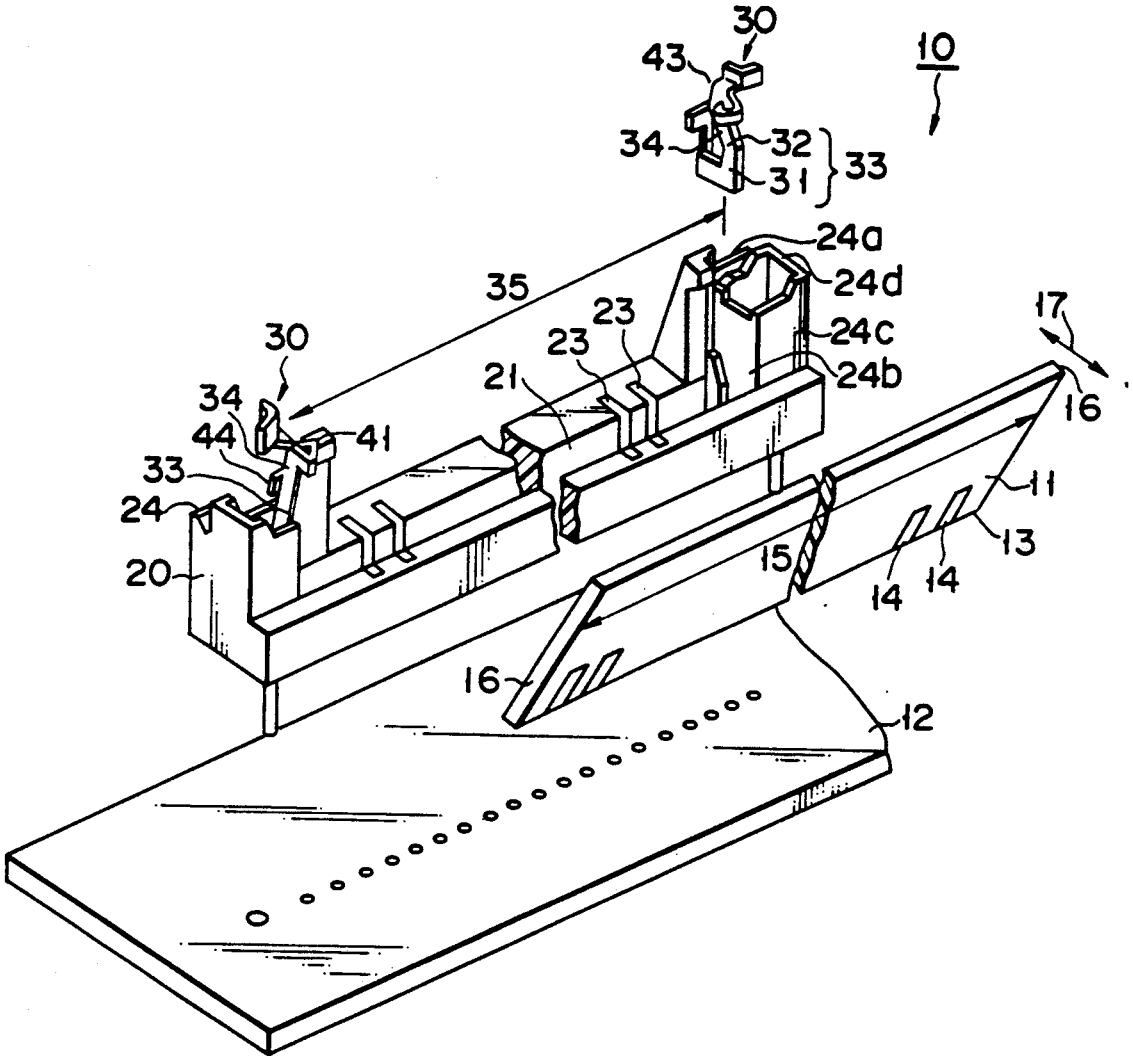
FIG. 3 is a partly-exploded, perspective view showing latching metal members and housing of a connector device according to one embodiment of the present invention.

FIG. 3 is a perspective, exploded view showing a connector device 10 according to the embodiment of the present invention. The first circuit board 11 is inserted in, and mounted on, the connector device 10 to electrically connect itself to the second circuit board by the connector device.

The connector device 10 includes a housing 20 made of an insulating material, such as plastics. The housing 20 has a longitudinally extending groove 21 where a plurality of connection terminals 23 are provided at given intervals along the length of the groove such that they are arranged as a row array. A plurality of connection terminals 14 are arranged, as a row array, along a side edge portion 13 of the first circuit board 11, come into elastic contact with and electrically connected to the corresponding connection terminals 23 at the groove 21 of the housing. It is possible to use, as connection terminals 23, any proper elastic connection terminals for the connection of a printed circuit board or a circuit board such as a single-in-line modulator (SILM). The connection terminals 23 of the housing is electrically connected to the second circuit 12 by any proper method for, for example, inserting the connection terminals into corresponding through holes provided in the second circuit board 12.

The connector device of the present invention has latching means at both the end portions of the housing so as to hold the first circuit board, which is inserted in the groove of the housing in a position where the connection terminals of the first circuit board are electrically connected to the connection terminals provided in the groove of the housing.

The connector device of the present invention has pair of latching members 30 made of a metal and having a mirror image relation to each other as shown in FIG. 3. The latch member 30 is formed by, for example, stamping out an elastic metal plate, such as phosphor bronze.

Figure 4:
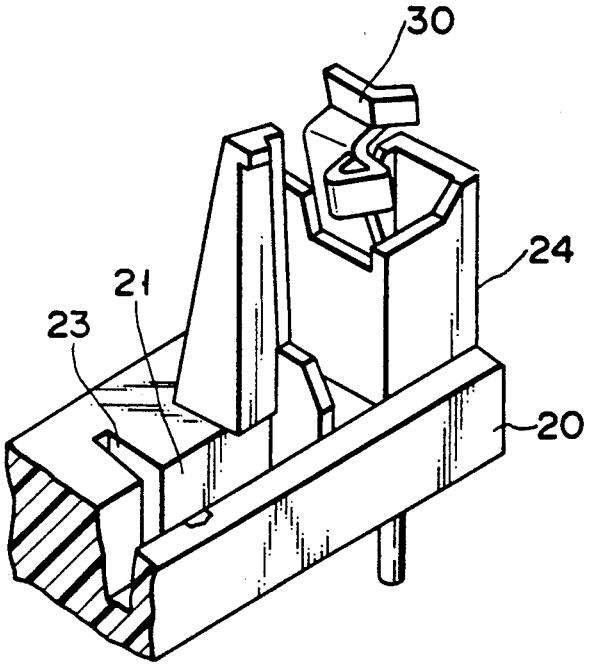
FIG. 4 is a perspective view showing part of the connector device with the latching metal members arranged in the housing in the embodiment shown in FIG. 3.
Figure 5:
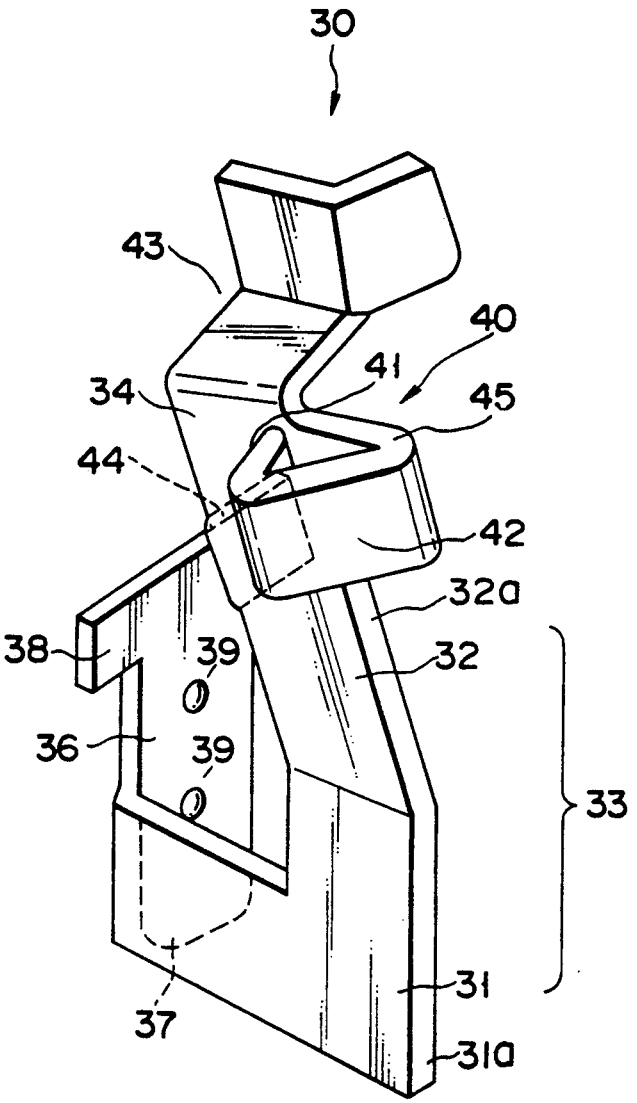
FIG. 5 is a perspective view showing the latching metal member shown in FIG. 3.

As shown in FIGS. 4 and 5, the latching member 30 has a strip portion 33 including a support beam 31 and a spring beam 32 extending from one end of the support beam 31.

As shown in FIG. 3, a pair of strip portions 33 are disposed at a distance corresponding to a length the first circuit board in a direction of the array of connection terminals such that they face each other. It is necessary that a spacing 35 defined by the mutually opposite faces 34 and 34 at the free end portions of the respective spring beams 32 and 32 be made somewhat narrower than the aforementioned length 15 so that the first circuit board 11 may be elastically held between the strip portions 33 and 33 by those elastic forces of the spring beams of the strip portions acting in a direction perpendicular to that in which the connection terminals of the first circuit board 11 are arranged as the row array with the side edge portion 13 of the first circuit board fitted in the groove 21 of the housing and held in elastic contact with the connection terminals, that is, in a direction perpendicular to a plane corresponding to a side face 16 as shown in FIG. 3. In the present embodiment, the spring beam 32 of the latching member 30 is obtained, by bending the strip from the support beam at a given angle, which provides a desired holding power at a narrowed spacing between those faces 34 and 34 at the free end portions of the spring beams of the respective strip portions 33 and 33. In the connector device of the present invention it is preferable that the metal strips of the latching means, each, include a spring beam adapted to make elastic contact with the first circuit board and a support beam adapted to support the base end of the spring beam and that the spring and support beams be obtained by bending a single metal sheet.

The connector device of the present invention includes holding means for holding the latching means with respect to the housing.

Figure 6:
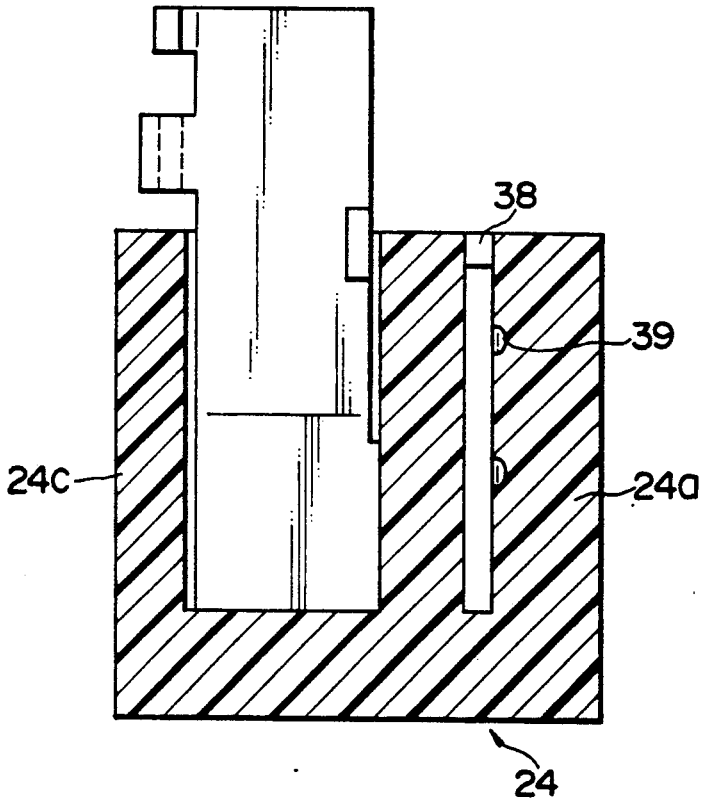
FIG. 6 is a cross-sectional view showing the lach member and the latch member holding section shown in FIG. 4.

The connector device of the present invention includes, as the holding means, a pair of holding beams 36 and 36, each, formed on an extension of the support beam 31 of the latching member 30 and a pair of latching member holding sections 24 provided on both the ends of the housing 20. The holding beam 36 has a pair of holding tabs 37 and 38 on its upper and lower ends and two dimples 39, 39 between the tabs. The latching member holding section 24 of the housing is of such a type that the latching member 30 is fixed to the housing 20 with the holding tabs 37 and 38 engaged to the latching member holding section. The latching member 30 is more positively fixed to the housing 20 through the frictional contact of the rear portion of the dimple 39 of the holding beam 36 of the latching member 30 with the inner surface of a first wall section **24*a* of the latching member holding section 24. The cross-sectional view of the latch member holding section 24 is shown in FIG. 6**.

It is preferable that the spring beam 32 of the latching member 30 be abutted against the inner surface of a second wall **24*b* of the latching member holding section 24 of the housing 20. By so doing, frictional contact is provided between the spring beam 32 of the strip and the second wall 24*b* so that the latching member 30 can be positively fixed to the housing 20 in the longitudinal direction of the housing 20. Further, a side surface 31*a* of the support beam 31 and side surface 32*a* of the spring beam of the latching member 30 lie on the same plane and the side surface 32*a* of the spring beam 32 of the latching member 30 is in contact with the inner surface or a third wall 24*c* of the latching member holding section 24**.

A fixing means for fixing the first circuit board which is held by the latching means in the connector device of the present invention to the housing in a direction of the thickness of the first circuit board will be explained below. With the first circuit board inserted in the groove of the housing and held there by the latching means, the first circuit board is pressed in the direction of its thickness by the elastic forces of all the connection terminals at the groove of the housing. It is, therefore, necessary to provide a fixing means for fixing the circuit board to its proper position against the elastic pressing forces of the connection terminals at the groove of the housing.

The connector device 10 of the present invention includes a fixing section 40 provided on the latching member 30 as the fixing means. The fixing section 40 includes a bent band-like section 45 extending from the side edge of the spring beam 32. As shown in FIG. 3, the paired latching members 30, 30 have the fixing surfaces 41 of their fixing sections lay on the same plane. Since, as set out above, the side surface **32*a* of the spring member 32 of the latching member 30 is held in contact with the third wall 24*c* of the latching member holding section 24, the fixing surface 41 of the fixing section 40 of the latching member 30 can support the circuit board 11, which is held in elastic contact with the connected terminals 23, against the elastic pressing force of the contact terminal 23 and, hence, the circuit board 11 is fixed to the housing 10 in the direction of its thickness as indicated by arrows, in FIG. 3, 17**.

In the connector device of the present invention, as shown in FIGS. 3 to 6, the band-like section 45 of the fixing section 40 of the latching metal member is preferably provided as a triangularly bent section and extends from an outer to an inner direction of the housing with the fixing surface 41 provided at the forward end of the surface 42 of the band-like section 45. By so doing, the surfaces 42 of the band-like sections 45 guide the first circuit board inserted in the groove of the housing, as will be later described in connection with the swinging motion of the first circuit board, and can displace the metal strip in a direction opposite to a direction of its elastic displacement for holding the circuit board between the latching members.

Upon the mounting of the first circuit board 11 on the connection device 10 as set out above, the circuit board 11 is diagonally inserted in the groove 21 of the housing 20 with its side edge 13 down, noting that the side edge portion of the circuit board 11 has the connection terminals as an array. Upon the swinging of the circuit board with the side edge 13 of the circuit board 11 inserted in the groove of the housing, the side face 16 of the circuit board 11 slides on the guide surface 42 of the fixing section 40 of the latching member 30, outwardly flexing the spring beam 32 of the elastic member 30. When the circuit board 11 completely passes on the guide surface, the circuit board 11 is held beween the paired spring beam 32 under the latter's elastic resilient forces. At the same time, the circuit board 11 is also supported by the fixing surfaces 41 of the fixing sections 40 of the latching members 30. In this way, the circuit board 11 is fixed to the housing 20, completing the mounting of the circuit board 11 to the connector device 10.

Upon the detachment of the once mounted printed circuit board 11 from the connector device 10, latching release tabs 43 which are provided each at the spring beam 32 of the latching member 30 on each end of the housing 20 are pushed away from each other in an outward direction of the housing. When this occurs, the spring beams 32 are elastically flexed in the outward direction of the housing with their areas of connection to the support beams as fixed ends, releasing a holding force. As a result, the printed circuit board 11 is pushed outside, by the elastic pressing forces of the contact terminals, to a pre-inserted position and can readily be taken from the connector device. The release tabs 43 are preferably of a Z-shaped type, as in the present embodiment, to allow the tabs to be readily pushed.

Further, it is preferable in the connector device of the present invention to provide, on the latching means, a structure which suppress a displacement of the metal strips opposite in direction to the elastic holding displacement whereby it is possible to maintain an elastic force for holding the first circuit board therebetween. That is, in order to prevent the spring beams 32 from being excessively flexed in the outward direction of the housing upon the detachment of the circuit board from the latching members, it is preferable to provide an over-stress prevention tab 44, as in the present embodiment, on a side opposite to that on which the fixing section 40 of the spring beam 32 of the latch member 30 is situated. When the elastic sections 32 are pushed away from each other in the outward direction of the housing 20, the tab 44 abuts against a fourth wall **24*d* of the latching member holding section 24 of the housing 20 to prevent any further outward displacement of the spring beam 32 and hence any further fatigue of the spring beam 32. It is, therefore, preferable to select the length of the tab 44** to suit the object intended.

The latching member 30, including the holding beam 36, support bean 31, spring beam 32, fixing section 40, latching release tab 43 and over-stress prevention tab 44, is preferably formed of a single metal sheet. The latching member 30 can be mounted on the housing 20 by fitting it in the latching member holding section 24 of the housing 20 made of an insulating material, such as plastics. The latching member mounted in the latching member holding section 24 can be readily be replaced by a new one by withdrawing it out of the latching member holding section 24.

Although the present invention has been explained in connection with the aforementioned embodiment, it is not restricted to this embodiment and various changes or modifications of the present invention can be made without departing from the spirit and scope of the present invention. In this example, although the support beams 31 of the latching members 30 have been explained as being L-shaped ones, they may take any proper shape in so far as holding the circuit board 11 therebetween under a proper elastic force. Although the first circuit board 11 has been explained as being held in a position perpendicular to that of the second circuit board 12, it may be held in a horizontal or diagonal position. Further, two or more circuit boards can be held in place by providing two or more grooves 21 in the housing 20 and providing a latching means in each groove so as to insert two or more circuit boards.

As set out above, according to the connector device of the present invention, the metal strips are utilized, as the latching means, in place of the conventional plastics latching sections, obtaining a stronger holding power and an improved withstand characteristic. It is also easier to manufacture them readily.

What is claimed is:

1. A connector device comprising:

a housing made of an insulating material, which has a groove including connection terminals, which terminals electrically connect a row array of connection terminals of a first circuit board with a second circuit board upon insertion of the first circuit board into the groove and rotation of said first board to a position at which latching means situated at the ends of the housing hold the first board in place and the first circuit board is partially housed in the groove;

latching means having a pair of metal strips mutually oppositely provided one at each end of the housing at an interval corresponding to a length of the first circuit board measured in a direction parallel to the row array of connection terminals, the pair of metal strips elastically holding the partially housed first circuit board therebetween under an elastic, compressive force, each metal strip including a spring beam for making elastic contact with said first circuit board and a support beam for supporting a base end of the spring beam, the support beam comprising two legs in a planar L-shaped configuration;

holding means for holding the latching means relative to the housing; and fixing means for positionally fixing the first circuit board, which is held by the latching means, relative to the housing in a direction of the thickness of the first circuit board.

2. The connector device according to claim 1, wherein, in order to maintain the elastic force with which the first circuit board is held between the metal strips, said latching means is equipped with an overstress protection structure for suppressing any displacement during deflection of the latching means.

3. The connector device according to claim 1, wherein a band-like section is provided which extends from each metal strip in a manner to be triangularly bent, one surface of the triangularly bent band-like section serving as a guide surface for the first circuit board inserted in the groove of the housing and deflecting the metal strips in a direction away from the first circuit board.

4. The connector device according to claim 1, wherein the spring and support beams are formed of a bent, single metal sheet.

* * * * *

UNITED STATES PATENT AND TRADEMARK OFFICE

CERTIFICATE OF CORRECTION

PATENT NO. : 5,232,400

DATED : August 3, 1993

INVENTOR(S) : Mon Shing Chang, Chou Lin Chen and Li-Chang Hsu

It is certified that error appears in the above-indentified patent and that said Letters Patent is hereby corrected as shown below:

On the title page, item [30] should appear as follows:

Foreign Application Priority Data

09/28/90 [JP] Japan 2-260313

Signed and Sealed this

Ninth Day of December, 1997

*Attest:*

Bruce Lehman

BRUCE LEHMAN

*Attesting Officer*

*Commissioner of Patents and Trademarks*